United States Patent [19]

Elliston

[11] 3,960,360

[45] June 1, 1976

[54] INTERNALLY PRESSURIZED LOAD SUPPORTING MAST

[75] Inventor: Thomas L. Elliston, Hurst, Tex.

[73] Assignee: Thomas L. Elliston, Fort Worth, Tex.

[22] Filed: June 27, 1972

[21] Appl. No.: 266,630

[52] U.S. Cl. ..... 254/139.1; 254/189; 166/77; 173/147

[51] Int. Cl.[2] ..... B66C 23/60

[58] Field of Search ..... 254/139, 139.1, 189, 254/188, 148, 143; 173/147, 149, 57, 143, 167; 166/77, 77.5; 52/69; 175/85

[56] References Cited

UNITED STATES PATENTS

| | | | |
|---|---|---|---|
| 1,928,958 | 10/1933 | Young et al. | 254/188 |
| 2,126,933 | 8/1938 | Stone et al. | 173/149 |
| 2,200,075 | 5/1940 | Caldwell | 173/57 |
| 2,239,493 | 4/1941 | Nichols | 254/188 |
| 2,552,637 | 5/1951 | McCallam | 173/149 |
| 2,683,424 | 7/1954 | Kane | 254/188 |
| 2,766,009 | 10/1956 | Wilson | 254/188 |
| 3,100,015 | 8/1963 | Regan | 166/77 |
| 3,151,686 | 10/1964 | Kammerer | 254/172 |
| 3,193,116 | 7/1965 | Kenneday et al. | 254/139 |
| 3,340,938 | 9/1967 | Wilson | 173/147 |
| 3,467,202 | 9/1969 | Brown | 173/57 |
| 3,682,259 | 8/1972 | Cintract et al. | 254/139 |
| 3,687,205 | 8/1972 | Mori | 175/5 |
| 3,708,020 | 1/1973 | Adamson | 173/149 |
| 3,714,995 | 2/1973 | Hanes | 254/172 |
| 3,752,229 | 8/1973 | Phidy | 166/77 |
| 3,792,836 | 2/1974 | Bender | 254/139 |
| 3,797,570 | 3/1974 | Leutwyler | 166/77 |

*Primary Examiner*—Robert J. Spar
*Assistant Examiner*—Kenneth Noland
*Attorney, Agent, or Firm*—Hubbard, Thurman, Turner & Tucker

[57] ABSTRACT

A workover rig for lifting or lowering oil well pipe into a well casing is disclosed. The rig has a mast structure adapted to communicate hydraulic fluid to a drive cylinder which actuates a pulley system operably connected to a pipe hoist or traveling block with remotely operable pipe engaging grips. The dynamic loading on the mast is minimized by the drive cylinder which is affixed to a cross head at the mast crown and the fluid pressure force in the mast which automatically compensates for shock and weight loads on the mast. A hydraulic control system is operative in a regenerative high speed mode to permit multiple speed operation of the hoist. The structure is adapted to be supported at the well casing to transfer the load from the oil well platform to the casing. The method includes operating the mast in conjunction with an adjustable tension winch to efficiently transfer pipe between the mast and pipe storage area.

58 Claims, 18 Drawing Figures

INTERNALLY PRESSURIZED LOAD SUPPORTING MAST

The present invention relates to a device for raising and lowering heavy equipment, and more particularly relates to a mast structure especially adapted for hoisting and lowering oil well pipe or tubing. Structures of this type are generally known in the art as workover rigs.

In the operation of production oil wells, it is often necessary to perform remedial or repair work on the well. If the production string of pipe is damaged or leaking, it may be required to pull the tubing from the casing. In other instances, repair work may be performed through the insertion of an appropriate tool into the pipe to ream out or flush out the material clogging the flow of oil through the pipe. When such operations become necessary, a portable installation called a workover rig is brought to the well site and set up. Generally, these rigs consist of a derrick or mast which supports pulleys or block and tackle arrangements that are operable to pull the string from the well. These prior art workover arrangements are usually heavy and difficult to erect and further often have the limited operational capability of only being able to force or pull pipe from a well without the capability of snubbing or pushing pipe back into the well. Since these conventional workover rigs cannot exert a downward force to push a string of pipe into the well, they necessarily must always have the well under control or "dead", as is known in the art. This may require a preparatory operation of injecting a suitable substance such as mud or "kill" fluid into the well to maintain a sufficient column weight of fluid to resist the pressure within the well which is tending to force the tubing out.

The problems encountered in working over a well are even more substantial when the oil well is located on an offshore platform. With an offshore well, it is necessary for the operator to hire a derrick barge to transport the workover equipment to the well platform. Further, the facilities available on the platform are limited and the utility crane, which is usually provided on most platforms, is often not of sufficient capacity to hoist bulky, weighty workover masts onto the platform. Therefore, the derrick barge must also be equipped with a heavy duty crane for loading and unloading the derrick structure onto the platform. These derrick barges are extremely expensive to lease and thousands of dollars can be expended by an operator in merely transporting the workover equipment to and from the offshore platform.

Another difficulty encountered with use of prior art mast arrangements is that due to their structural design, they are extremely heavy and impose a severe load on the existing well platform. When a mast rig is operating to pull pipe or tubing from the casing of an offshore well, the weight of the string of pipe, as well as the weight of the mast structure, has to be carried by the platform, which often is structurally insufficient to accommodate these additional loadings. Therefore, it is often not possible to use conventional workover mast structures on existing platforms without creating an unreasonable danger of structural failure of the platform. Collapse of a platform could result in loss of life, and certainly severe economic loss to the well operator. The workover rig of the present invention overcomes the aforementioned inadequacies of the prior art. The present invention employs a derrick structure having capability to both push and snub well pipe tubing in workover operations. The operations may be performed at multiple speeds at the selection of the operator. The mast structure is of a unique design which hydraulically compensates for loads imposed on the mast by the raising or lowering operation, thereby permitting the mast to be constructed of lighter structural members than are presently required for masts of comparable capacity. The reduced size and weight of the mast makes the mast more easily transportable and accommodable on most existing well platforms. Existing platform utility cranes will normally be adequate to handle the workover rig of the present invention. Further, the mast is designed so that the weight and operational loads are not placed on the well platform, but rather these loads are transferred to and supported at the well casing.

The mast of the present invention may be used with a novel adjustable tension winch to expedite the pipe handling procedure. The winch and the pipe engaging members of the traveling block in the mast are both remotely hydraulically controlled and may be operated in a coordinated manner so that an experienced crew can run up to 50% more joints of pipe than is presently possible using existing mast structures.

The present invention employs a derrick structure in which main vertical structural members also serve as hydraulic fluid supply lines to a cylinder which actuates a pulley system that reciprocates a pipe engaging traveling block or hoist along the structure. The actuating cylinder is structurally tied to the top of the derrick and the differential cable arrangement imparts, for example, a forty foot stroke to the block with only a twenty foot stroke cylinder. Introduction of pressure fluid to the cylinder through the main vertical structural members of the mast compensates the mast against the compression loads imposed on it by the pipe handling operation. The device of the present invention also has capability both to pull pipe from the well casing as well as snubbing or pushing it into the well. A regenerative hydraulic system permits multiple speed operation of the traveling block for efficient operation. The entire structure is adapted to be secured at the well head so that during workover operations, minimum loadings or stresses are placed upon the well platform. Remotely operable pipe gripping slip and snubber devices are associated with the traveling block to grip the pipe during the mast operation.

The workover rig of the present invention is extremely light and portable and may be transported to offshore well platforms by work boats, eliminating the necessity for leasing large derrick barges for transportation of such rigs to the well site. Further, the existing utility cranes available at most well platforms are adequate for hoisting the mast of the present invention into position for use.

Thus, from the above brief summary, it will be seen that the illustrated apparatus comprehends the following:

1. differential cable arrangement
2. pressure compensated mast structure
3. regenerative hydraulic power system
4. support of mast on well head
5. structural supporting main cylinder at mast crown
6. adjustable tension winch apparatus and operation.

An understanding of the above features as well as other features and objects will become apparent from the following description of the invention and the drawings, in which.

Figure 1:
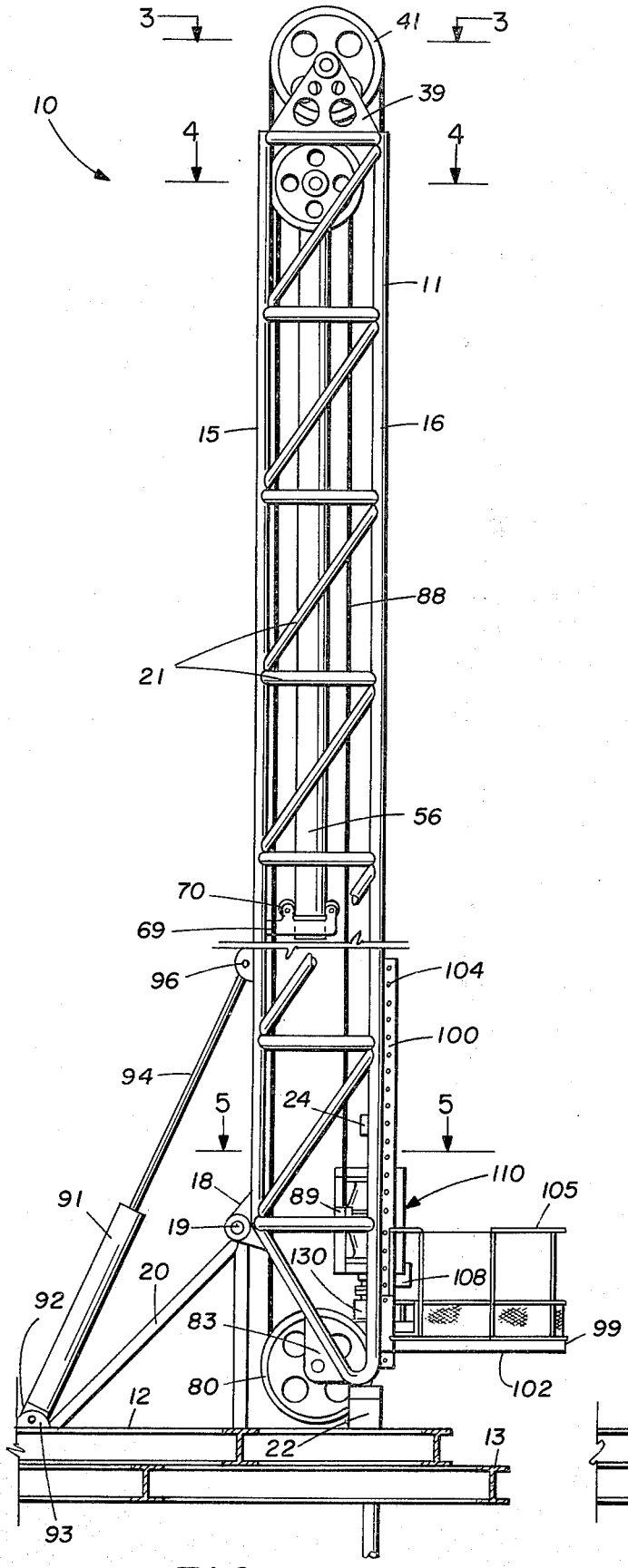
FIG. 1 is a side elevational view of the mast of the present invention.
Figure 3:
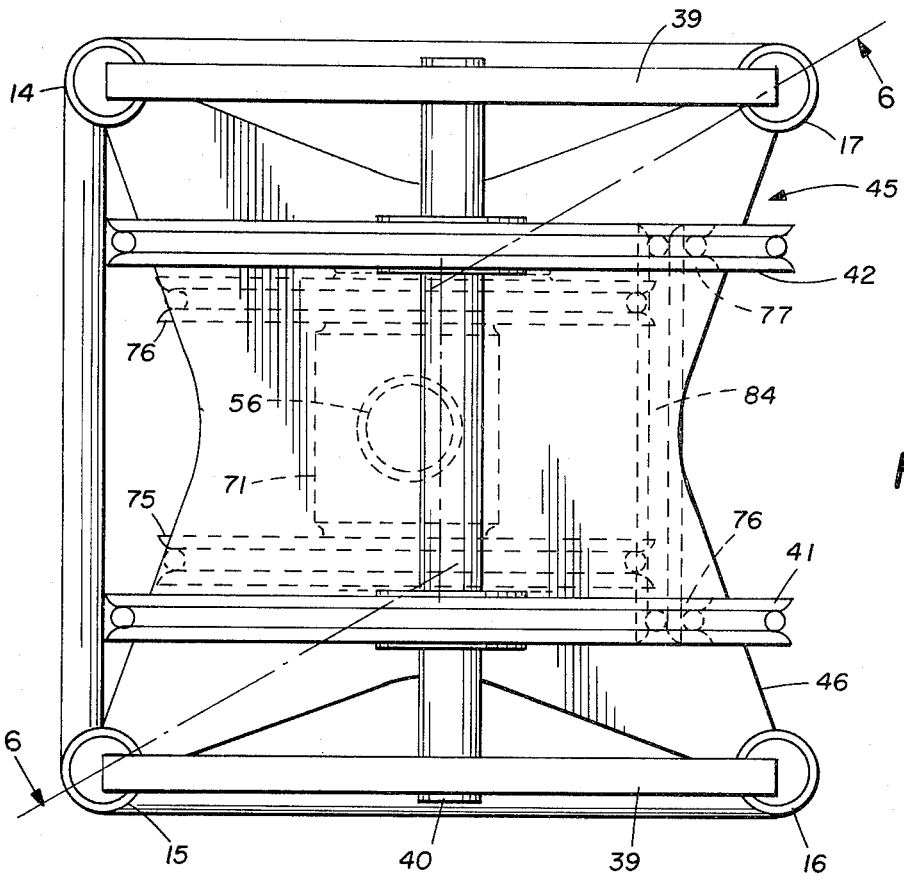
Figure 4:
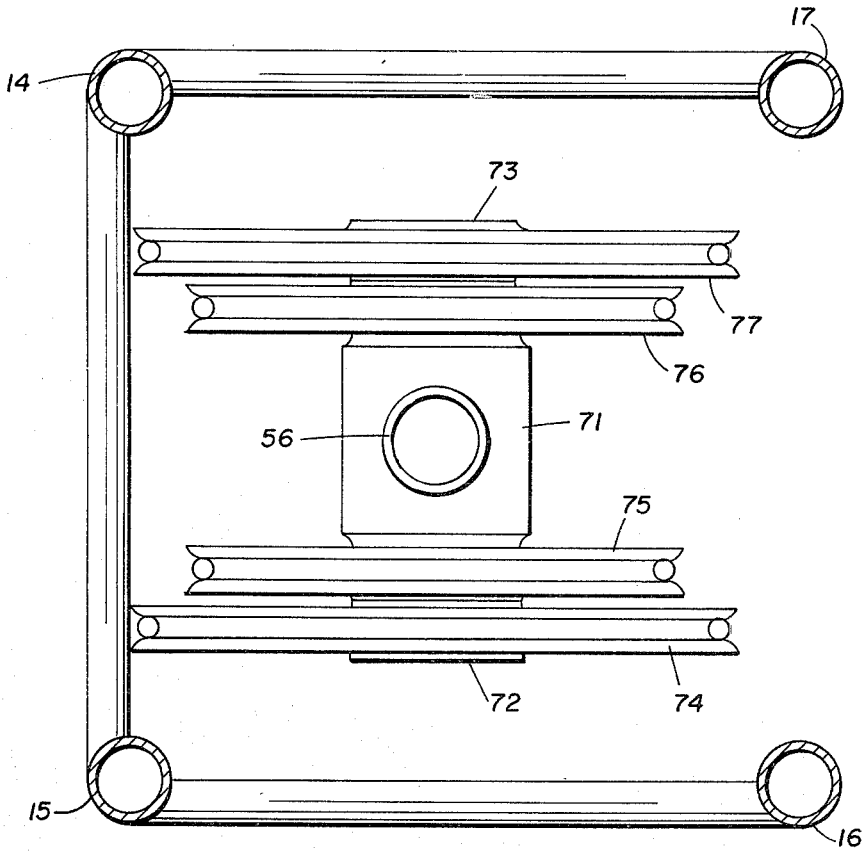
Figure 6:
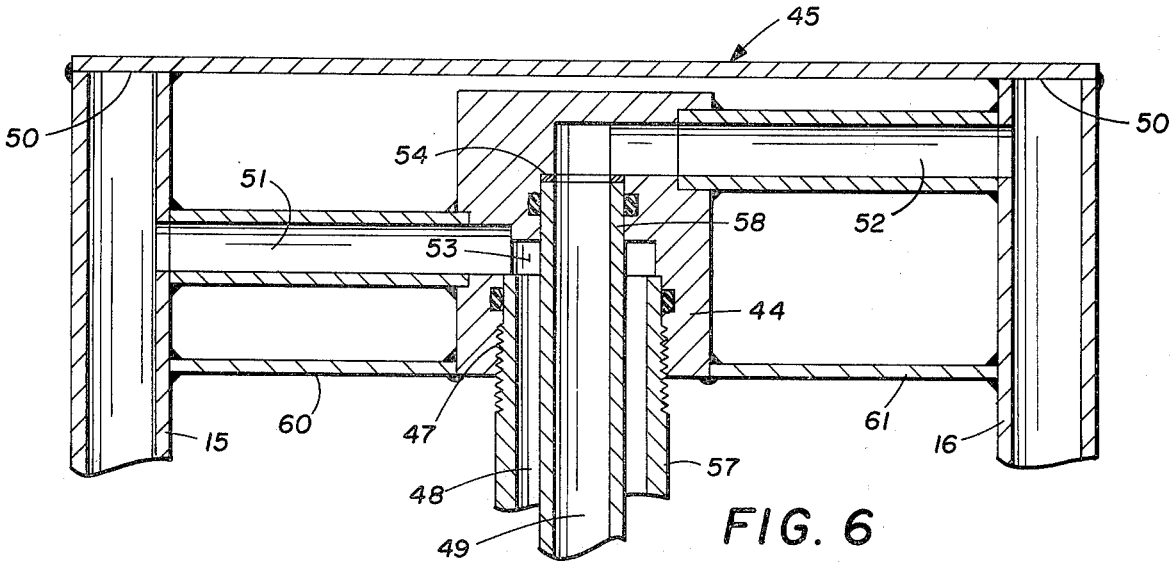
Figure 5:
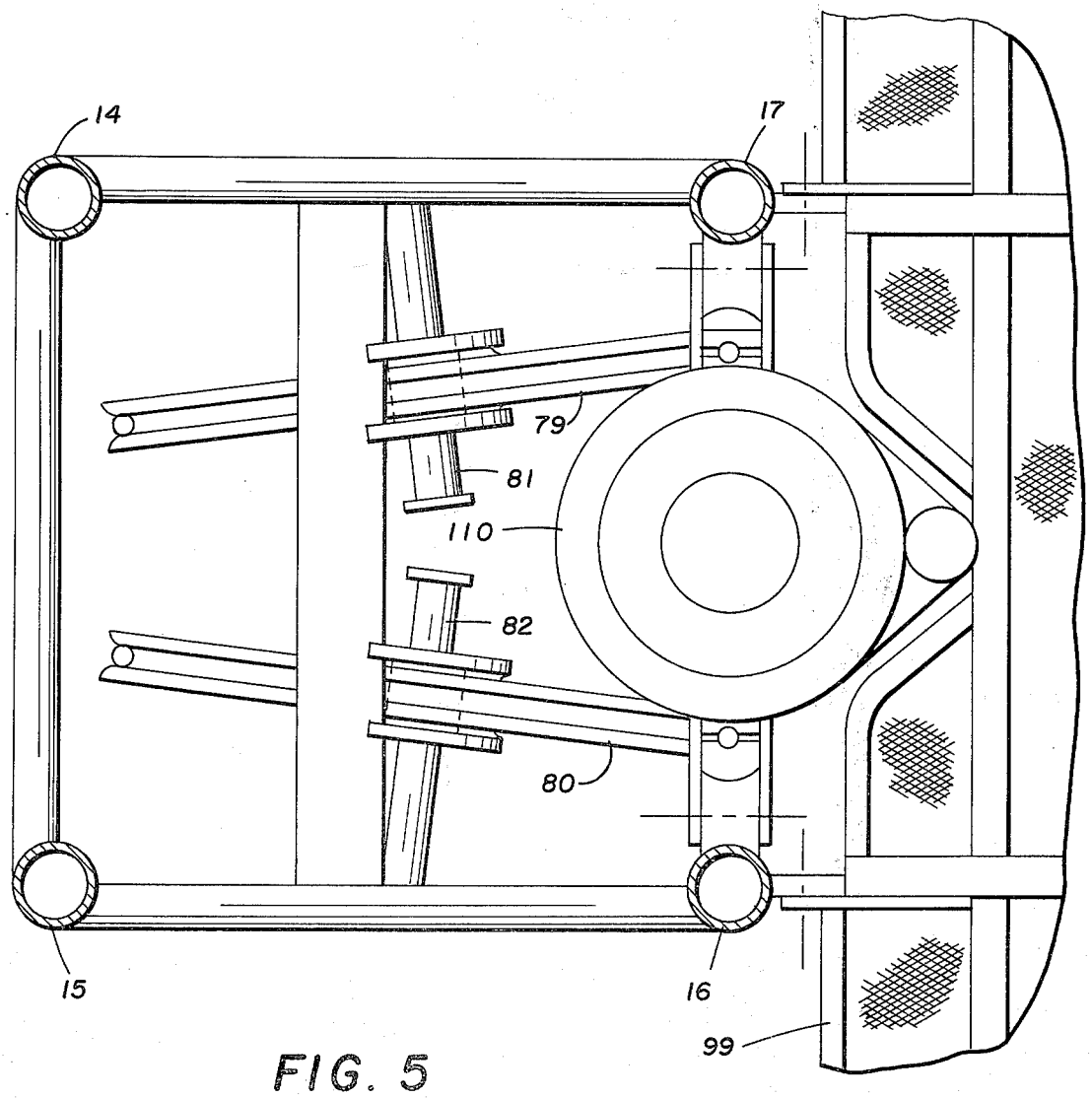
Figure 7:
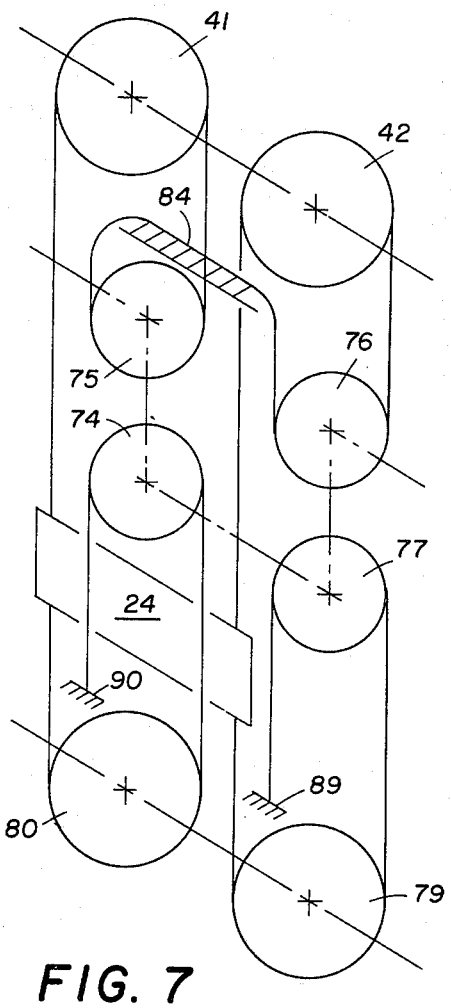
Figure 9:
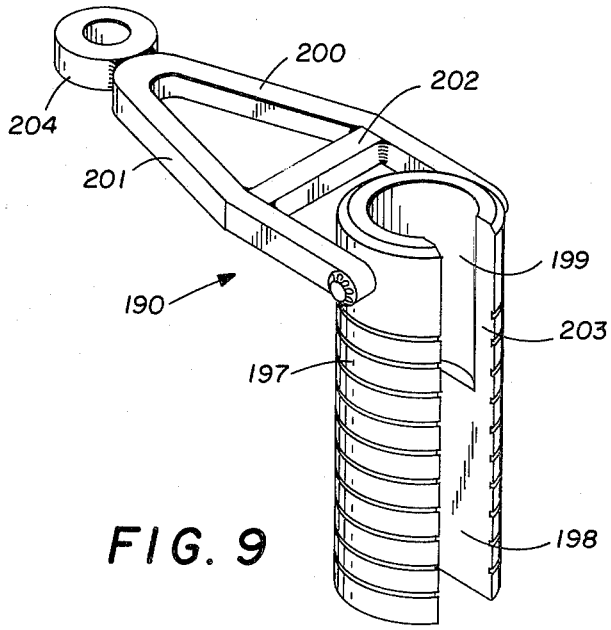
Figure 10:
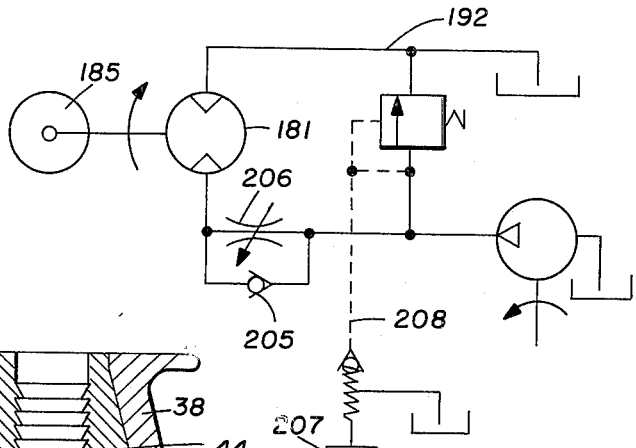
Figure 8:
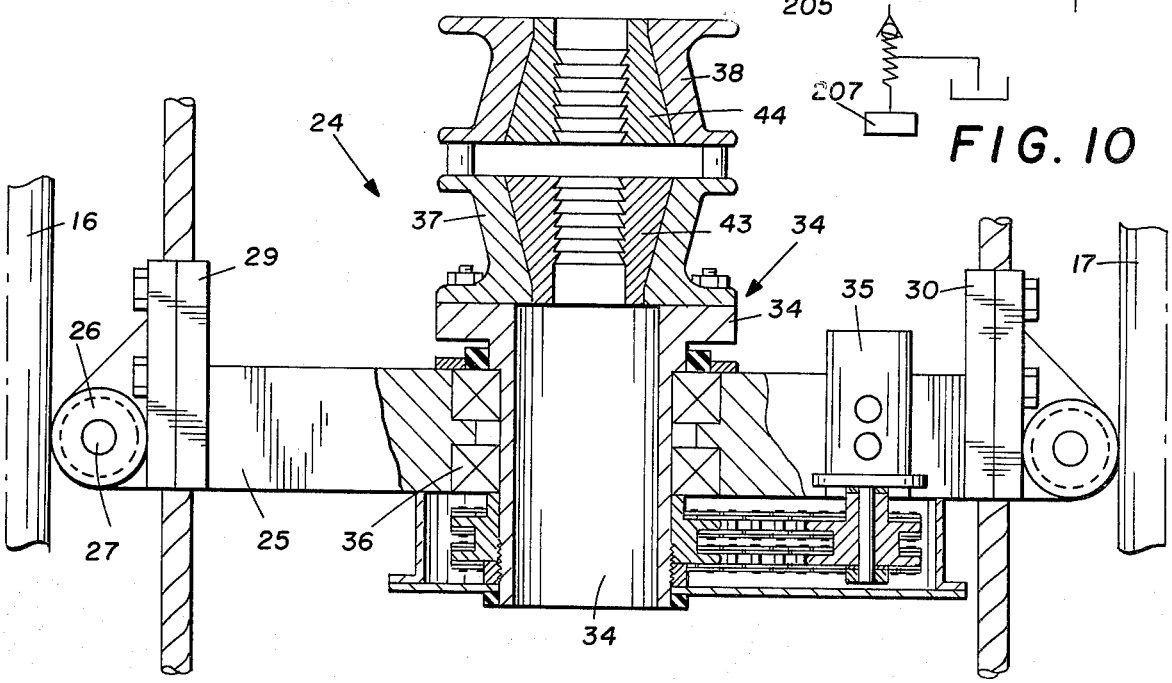
Figure 11:
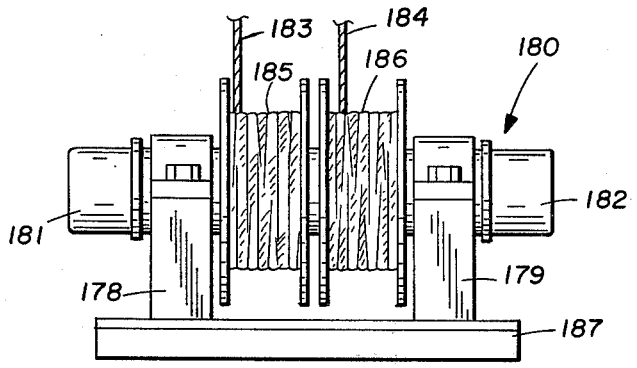
Figure 12:
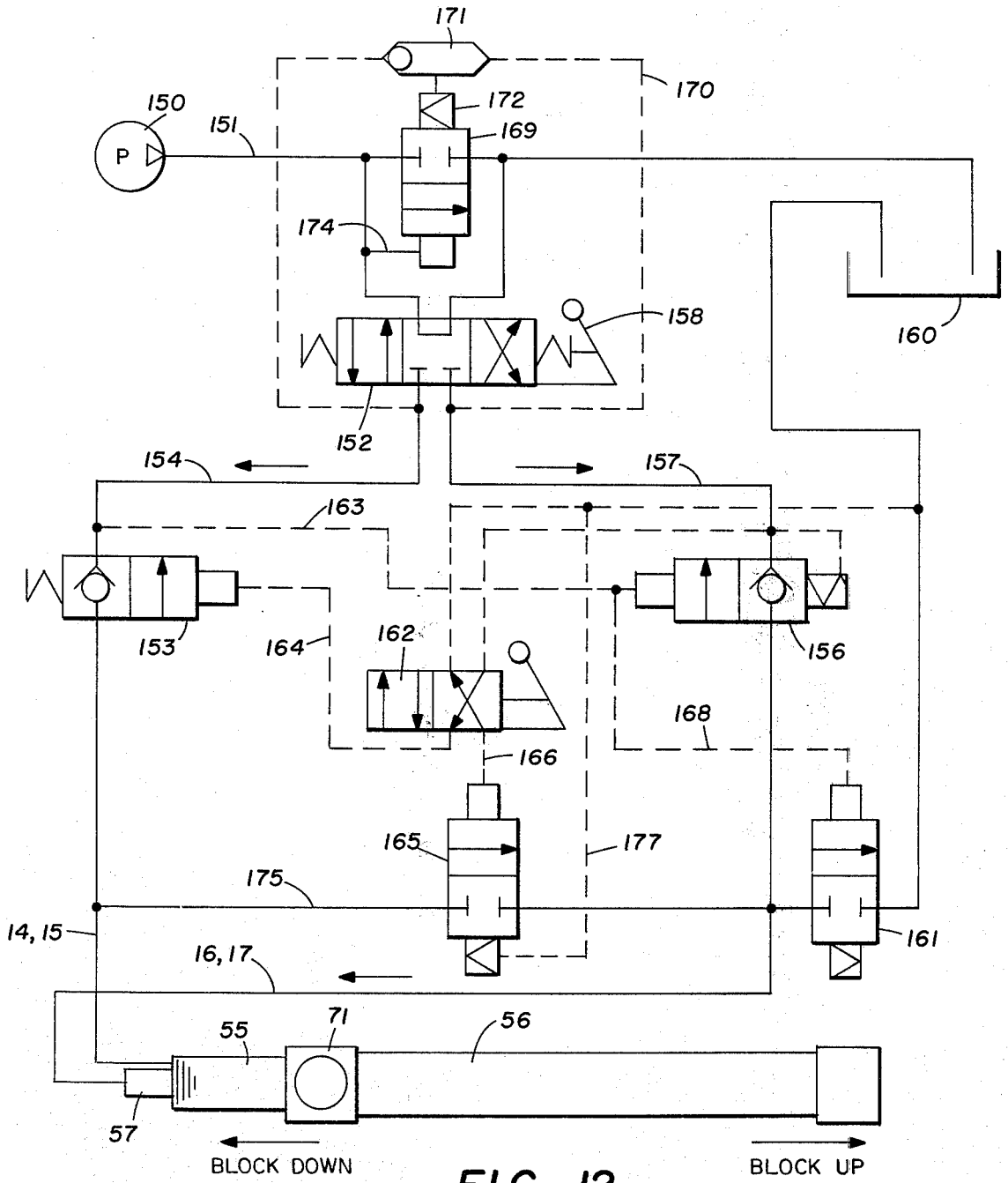
Figure 13:
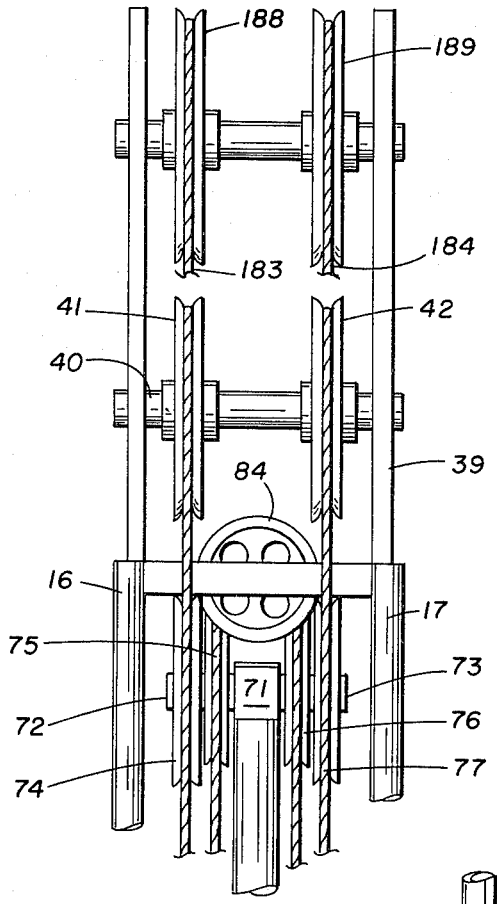
Figure 14:
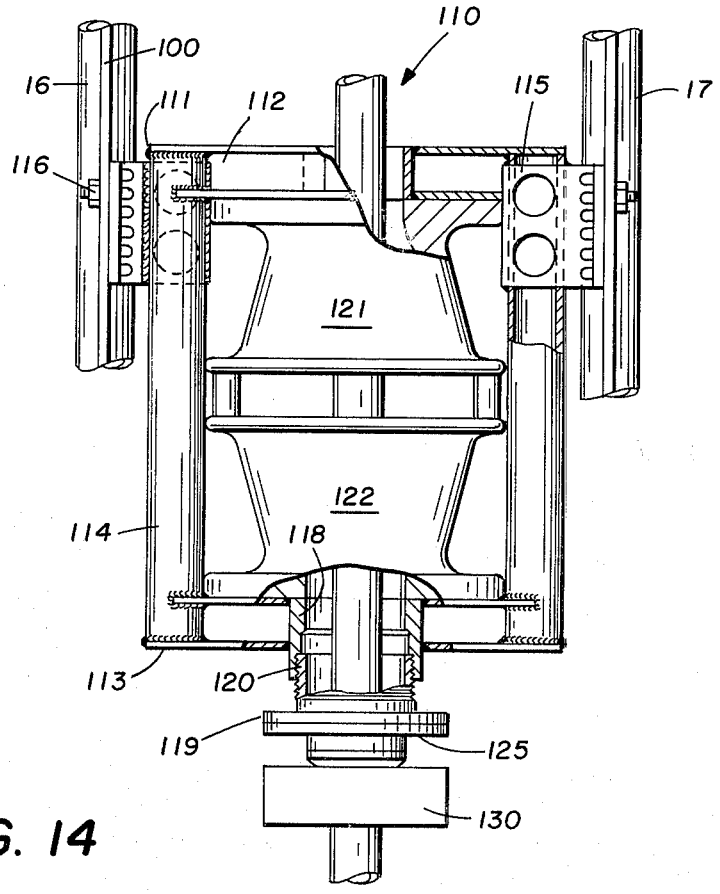

FIGS. 3, 4, and 5 are enlarged sectional views taken, respectively, along lines 3—3, 4—4, and 5—5 of FIG. 1;

FIG. 6 shows a sectional view of the mast cross head taken along lines 6—6 of FIG. 3;

FIG. 7 is a schematic representation of the pulley system;

FIG. 8 is a detail view of the traveling block;

FIG. 9 is a schematic of the winch hydraulic system;

FIG. 10 is a detail perspective view of the pipe handling elevator,

FIG. 11 shows the double winch arrangement;

FIG. 12 represents schematically the main hydraulic system;

FIG. 13 is a partial detail view showing the mast rigged from the double winch;

FIG. 14 is a detail view of the well head adaptor; and

FIGS. 15 to 18 illustrate the coordinate use of the mast and winch of the present invention to pull pipe.

Figure 2:
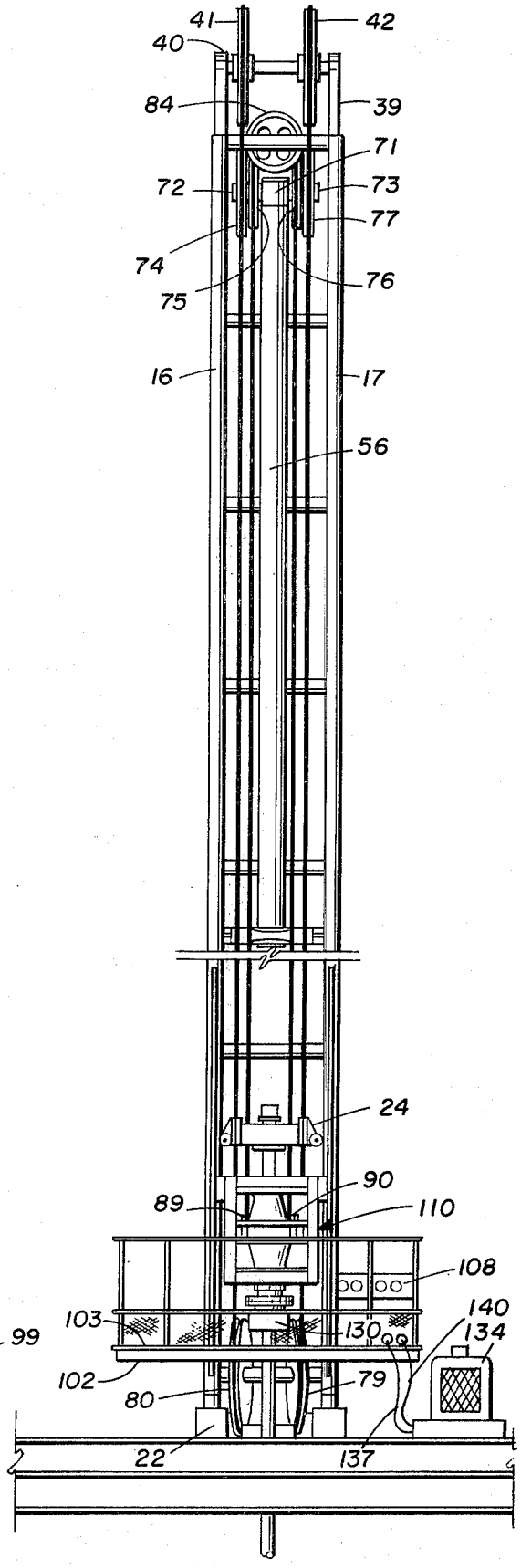
FIG. 2 is a front elevational view of the mast of the present invention.

Referring now to the drawings, and more particularly to FIGS. 1 and 2, the workover rig generally designated by the numeral 10 is shown having an upstanding mast member 11 mounted on skid member 12. Skid member 12 is broken for purposes of illustration and would normally be of sufficient length, approximately the mast height, to give stable support to the mast 11. The rig is shown in position on the platform 13 of an offshore well. The mast structure 11 is defined by four tubular upstanding members 14, 15, 16, and 17 which are generally arranged at the corners of a square. Rear legs 14 and 15 terminate at a location above skid 12 at a clevis 18 which receives a pin or shaft member 19 which pivotally secures the legs to triangular frame member 20. Frame 20 is affixed to the upper surface of the deck or skid 12. The front legs 16 and 17 of the mast structure rest on pad members 22. The mast is provided with adequate structural cross bracing members 21 to insure rigidity of the structure. Because of the unique design of the mast of the present invention, as will be described in greater detail hereafter, it is necessary that the mast structure 11 be structurally capable of supporting only its own weight during erection of the mast. Operational loads imposed on the mast are minimized so that the size and weight of the structural components of the mast can be substantially reduced as compared with conventional masts of similar size.

Vertically guided along the front legs 16 and 17 of the mast is traveling block 24, which is best detailed in FIG. 8. The block 24 is reciprocated along the front legs 16 and 17, which serve as guides. Main cross member 25 of block 24 extends horizontally between legs 16 and 17, having guide rollers 26 rotatably mounted about shafts 27 at either end of the frame. The periphery of the rollers are concave to conform to the shape of tubular members 16 and 17 and vertically guide the block as it is reciprocated along mast 11. Cable clamps 29 and 30 are affixed to body member 25 to secure the drive cables to the traveling block. A rotary table 33 is carried by the body 25 of the traveling block to facilitate cleanout or drilling operations.

The construction of rotary table 33 is well known and includes spindle 34 which is mounted by rotation in bearings 36 and is driven by a hydraulic motor 35 through a chain drive from the output shaft of motor 35. Flange 31 of spindle 34 supports the pipe gripping assembly consisting of a slip bowl 37 and a snubber bowl 38 arranged to engage pipe extending through central opening in spindle 34. These fixtures are well known in the art and generally include a conical bowl having a set of pipe slips or jaws which are adapted to grip the periphery of the pipe. The pipe gripping jaws can be moved into or out of engagement with the pipe surface by means of a hydraulic piston or other power means. The slip bowl 37 is designed having its jaws 43 adapted to engage the pipe to prevent the weight of the pipe from causing the pipe to slip into the well hole. The jaws 44 of the snubber bowl 38 are adapted to engage the pipe to secure it against upward displacement, as for example, to restrain the pipe against well pressure or when the pipe is being pushed into the hole. The fixtures 37 and 38 can be remotely operated by control means located for operator access at the operator platform. The power to raise and lower the traveling block is provided by hydraulic cylinder and transmitted to the block by a cable arrangement which will now be described.

Referring to FIGS. 1 and 2, a pair of triangular bearing brackets 39 oppositely extend from the side of the mast at the top. A shaft 40 is rotatably mounted in bearing blocks provided in brackets 39. Crown sheaves 41 and 42, adapted for use with steel cable, are mounted on shaft 40 for rotation. The diameter of sheaves 41 and 42 approximately corresponds to the width of the mast 11.

As best seen in FIGS. 3 and 6, extending transversely across the top of the mast is cross head 45, which is secured at the front and rear legs of the mast and structurally serves as a mounting for the cylinder powering the pulley system. Cross head 45 includes socket piece 46 supported at the vertical centerline of the mast by lateral members 60 and 61. A threaded bore 47 is provided in cross head member 44 at the approximate longitudinal centerline of the mast. A stepped concentric blind bore 54 extends from the bottom of threaded bore 46. Cylinder rod 57 is threaded in engagement at 54 having reduced diameter end 60 extending to bore 54. Annular chamber 53 surrounds a portion of extension 50 and communicates with annular passage 48 in the rod. First passage 51 connects annular passage 53 with rear legs 15 and 14. Similarly, lateral flow passage 52 interconnects the front mast legs 16 and 17 to central passage 49 in rod 57. Appropriate sealing O-rings protect against fluid leakage. End caps 50 block off the upper end of legs 14 to 17 and provide an area against which fluid pressure within the legs exerts an upward force.

It will be seen that piston rod 57 remains fixed to the cross member 45 so that pressurization of either the head or rod chamber of cylinder 55 through the front or rear legs, respectively, will cause the cylinder housing 56 to extend or retract. The interior of the front legs of the mast are placed in communication by the cross head porting arrangement and passage 52 with the head end of the main cylinder 55, while the rear legs are placed in communication through the cross head and passage 51 with the rod end of the cylinder 55. Therefore, when the head end of cylinder 55 is pressurized in the lifting mode, the total pressure force acting at end caps 50 of front legs 16 and 17 is equal to the compressive load imposed on the legs due to the weight carried at block 24. The front legs are then always pressure compensated to adapt to the load conditions.

A bracket 69 extends forwardly from the rear legs of the mast at a location adjacent the lower end of cylinder housing 56 when the cylinder 55 is retracted. Rollers 70 are carried on brackets 69 and engage the outer periphery of cylinder housing 56 at opposite sides. Rollers 70 serve to slidably guide housing 56 as it vertically extends and retracts as cylinder 55 is pressurized.

Mounted adjacent the upper end of cylinder housing 56 is circular collar member 71 which carries horizontal trunnions 72 and 73 which extend toward opposite sides of the mast. Pulley sheaves 74 and 75 are rotatably mounted on trunnion 72 and sheaves 76 and 77 are rotatably carried on opposite trunnion 73. Reciprocation of the housing 56 of cylinder 55 will vertically displace these pulleys and will reciprocate traveling block 24 through the cable system as will be more fully explained.

A pair of lower pulley sheaves 79 and 80 are rotatively mounted on shafts 81 and 82 which are affixed to brackets 83 extending from the lower mast cross brace member. The axes of lower pulley shafts 81 and 82 intersect in an angular relationship, as best seen in FIG. 5, so that the lower sheaves define a general V-shape. This facilitates interconnection of the cable system to the pulley sheaves.

Another pulley sheave 84 is secured to the mast at an elevation just below the crown pulleys and is positioned with its rotative axis perpendicular to the axis of shaft 40 with the plane of sheave 84 being generally parallel to the plane defined by legs 16 and 17 of the mast. Sheave 84 serves to equalize forces within the pulley system as a crossover member for the cable of the transmission system. Other crossover means, such as a stationary race or shoe, would also be effective.

The power transmission system is represented schematically in FIG. 7 and is best understood by reference to this figure. Reference should also be made to FIGS. 1 and 2. The power transmission system includes a single continuous cable 88 which is connected at one end at clamp 89 to the lower mast cross member and extends upwardly around outer cylinder pulley 77, down around base pulley 79, up around crown pulley 42, downwardly around inner cylinder pulley 76, across the equalizing pulley 84 to the other half of the cable arrangement. The cable then engages inner trunnion pulley 75 and wraps around crown pulley 41 and extends downwardly to the base pulley 80 and upwardly over the outer trunnion pulley 74 and terminates at opposite cable clamp 90. Equalizing pulley 84 serves to reduce side loads and cocking imposed on the pulleys of each half of the power transmission system. This arrangement is a differential system known as a double purchase arrangement which has two parallel cable portions extending vertically between the front legs of the mast to which the block 24 is secured by the clamps 29 and 30.

It will be seen that when the head end of cylinder 55 is pressurized to move housing 56 and pulleys 74 to 77 downwardly, traveling block 24 will be raised, guided on rollers along the front mast legs. Conversely, when cylinder housing 56 is oppositely pressurized to cause the cylinder housing to retract, that is, return to a position toward the top of the mast, traveling block 24 will be caused to lower on its rollers between the front mast legs as a downward pull is exerted on the parallel cable portions adjacent the front legs of the mast.

With the differential pulley mechanism described, trunnion mounted pulleys 74 to 76 can be extended over approximately half the vertical length of the mast driving traveling block 24 to traverse the entire length of the mast along front legs 16 and 17. Thus, it is possible to achieve an effective working stroke of the block which is a multiple of the cylinder length. For example, a twenty foot cylinder can, with the present arrangement, effectuate a forty foot stroke at the block. Obviously, other multiples can be used effectively. The design is particularly advantageous in that it considerably reduces the cost and size of the hydraulic cylinder and weight of the mast to make handling and transportation more expedient.

Cylinder 91 is provided for raising and lowering the mast structure from a horizontal to a vertical position on the skid 12. The end of cylinder 91 is provided with a clevis bracket 92 on the cylinder housing. Clevis 92 is pivotally connected to bracket 93 which is welded to the upper surface of skid 12. The rod 94 of cylinder 91 is provided with a bore in its outer end which is connected by a removable pin 96 to a clevis bracket 96 affixed to the rear vertical legs of the mast. Thus, it will be seen that by pressurizing cylinder 91 to extend rod 94, the mast 11 is pivoted about pin connection 19 to a vertical position. By retracting cylinder 91, the mast 11 will be caused to pivot about connection 19 to a horizontal position. An appropriate deadman post or stop will be provided on the skid 12 to engage the mast structure in the horizontal position. With this construction, the pins at 19 and 96 may be removed and the mast assembly separately hoisted from the skid by a utility crane for transportation purposes.

A platform 99 to accommodate a work crew is horizontally supported from the front legs of the mast structure at an elevation convenient to workover operations. A vertical bracket 100 is affixed to each of the forward legs and is provided with an aligned vertical column of holes 104. The platform 99 consists of frame members 102 which support the working surface 103 which is shown as being a checker plate or safety plate. The support frame 100 is pinned to the holes 104 at the desired height, permitting the platform to be lowered or raised. A hand railing 105, provided around the periphery of the platform, encloses the platform and reduces the possibility of accidents. The forward part of the platform immediately adjacent the mast contains a panel 108 which houses hydraulic valves that control the hydraulic actuation of the various components as will be explained.

Adjustably affixed near the lower end of front legs 16 and 17 of the mast, as best seen in detail in FIG. 14, is well head stack 110. Well head stack 110 includes a housing 111 defined by spaced apart upper and lower plate members 112 and 113, vertically interconnected tubular members 114. Perforated brackets 115 affixed at opposite sides of upper plate 112 are adapted to align with holes 104 in mast brackets 100 for attachment by means of pins or bolts 116. An internally threaded collar 118 is located in bottom plate 113 in alignment with the well pipe axis. Flange 114 carries threaded member 120 which engages collar 118. The threads are preferably of a configuration to permit quick advancement. The bolt circle of flange 119 is adapted to align with the bolt holes at the well head at blow out preventer 130.

Pipe gripping devices in the form of a snubber bowl 121 and a slip bowl 122 are supported within housing 111. These pipe engaging features are similar to the ones previously described with reference to the traveling block, and serve as pipe gripping fixtures to secure the pipe against vertical movement. The two pipe gripping jaws within the snubber bowl 121 and the slip bowl 120 are hydraulically actuated and may be remotely controlled at panel 108 at the work station.

The operation of the mast will be described in detail hereafter, but it will be seen that by virtue of member 120 and the variability available along brackets 100, substantial vertical adjustment of the position of the well head stack 110 can be obtained. This is highly desirable and makes the rig adaptable to most existing wells since the elevation of the well head with reference to the surrounding deck elevation will vary considerably with the particular well installation. The particular installation depicted shows the well head at an elevation above the platform 13. However, the design of the present invention can accommodate the well head terminating at most any reasonable distance above or below the deck surface of well platform 13.

Below the terminal end of the well head, provision may be made for incorporation of a blow-out preventer mechanism 130. Blow-out preventers are well known and serve generally to isolate the well hole from the atmosphere in case of excessive pressure development within the well hole.

As stated in the introduction, another important feature of the present invention is the manner and location at which main cylinder 55 is affixed to the mast. As previously described with reference to FIGS. 1 and 2, rod 57 of cylinder is secured to the mast at the cross head 45 near the upper end of the mast. Contrary to this, prior art pulley arrangements for workover rigs secure or tie the drive cylinder 55 that reciprocates the pipe lifting mechanism to the platform or lower deck. A conventional cylinder hook-up would result, as a matter of mechanics, in a multiple of the weight load exerted at the traveling block imposed on the derrick in compression forces. However, with the cylinder tied to the upper end of the mast at the cross head and in vertical alignment with the centers of the crown and base pulleys, the force exerted in extending the cylinder will offset the compression load imposed at the crown pulley. Therefore, the main load imposed on the mast of the present invention is the weight load carried at the traveling block.

To further reduce the structural requirements of mast 11, the mast is internally pressurized by hydraulic fluid to increase the rigidity of the structure and to compensate for the forces placed on the structure. By employing the pulley system described, the primary load imposed on the mast of the present design is the load experienced at the traveling block due to the pulling or pushing operation. The tubular front legs 16 and 17 of the mast are selected so that the cross sectional area of the hollow portion of each is approximately equal to one fourth the area of the piston in cylinder 55. Therefore, the total internal cross sectional area of the front legs approximates one-half of the piston of cylinder 55 which equals the hook load. A hydraulic power supply 134, including a diesel engine or other prime mover connected to drive a suitable pump, supplies motive fluid to the cylinder. The hydraulic power unit also includes the reservoir, interconnecting piping, and filters, as required. The fluid power supply is connected to the control valve 170 at the panel 108 by fluid pressure line 137 and return line 140. The front legs 16 and 17 of the mast are connected to control valve 170 through line 157 and the rear legs of the mast are coupled to the control valve via line 154 using conventional hydraulic lines and couplings. The details of the system will be described with reference to FIG. 12. It will be noted that the hydraulic power supply 134 may be located on the well platform 13 at any convenient position.

The pressure developed in cylinder 55 acting on the cylinder end to extend the cylinder housing will be a function of the weight imposed at the traveling block. The two front mast legs 15 and 16 together have an area equal to one-half the area of the cylinder. Therefore, the total pressure force exerted within tubular members 16 and 17 and acting against the end caps 50 of the cross head at the upper end of the legs will be equal to the total force imposed by the weight at the traveling block 24. In other words, the internal pressure force generated by the pump and communicated to the cylinder by the legs compensates for the loads and the mast is virtually neutral with no vertical loadings imposed upon it. The only loads that the mast must be capable of withstanding are loadings imposed by wind, torque, vibration, and its own weight when being hoisted into position as described. Similarly, rear legs 14 and 15 are selected to have a total cross-sectional interior area approximately equal to one-half the annular area of the piston in the rod end of cylinder 55 with which they communicate.

It will be apparent that at all times the fluid pressure existing in the front two legs is that existing in the head end of the cylinder and the pressure in the rear legs equal to the pressure in the rod end of the cylinder and thus the structure is always continuously compensated relative to the load imposed on it. The compensated mast system described above also serves to compensate shock loads as well as balance hook loads. Equipment of the nature of this invention is often exposed to severe duty cycles. For example, oil operators and drillers, in order to obtain maximum efficiency, will operate the equipment at maximum speed. A crew member is apt to lower a pipe at free fall velocity and within a few feet of the bottom and then will suddenly apply breaking force to stop the pipe. Such operation can impose extreme shock loads due to the deceleration of the heavy pipe moving at high velocity. Conventional masts are designed with a safety factor of three or four to withstand shock loading. However, with the mast of the present design, the pressure compensated structure automatically accommodates and resists such sudden shock loads and the additional bulk and expense due to high design safety factors is not necessary. If the traveling block 24 is descending rapidly, cylinder 55 will be retracting, that is, housing 56 will be moving upwardly, as pressure fluid is introduced into the rod end of the cylinder through the rear legs of the mast. To suddenly stop the load, the operator will return the control valve to a neutral position, blocking pressure flow to the cylinder and also blocking return flow which will have the effect of quickly decelerating the piston within the hydraulic cylinder. The deceleration forces imposed will cause a proportional increase in pressure in the head end of the cylinder which will be transmitted to the front legs of the mast and will exert an upward force at the caps 50 on the cross head opposing the downward force imposed on the derrick by the deceleration shock loading. Therefore, although the operator can impose a shock load on the derrick, the derrick can always accommodate the load as the mast serves to contain the hydraulic pressure, rather than having to structurally support the loads. As is conventional, a relief valve is also imposed in the control system to prevent damage to the hydraulic system.

Referring to FIG. 12, which schematically represents the hydraulic system, numeral 150 represents a pump which is of a constant delivery type such as a rotary gear pump. A pressure compensated four-way valve 170, as shown enclosed by dotted lines, controls the direction of operation of the traveling block 24. Valve 170 includes control spool 152 having actuator handle 158 adapted to position the spool. Spool 152 is a three-position, four-way spool which, when positioned in the left position (straight through), will cause the traveling block 24 to lower in a snubbing operation by delivering motive fluid to the rod end of cylinder 55 through line 154. When spool 152 is actuated leftwardly so that it is placed in its extreme right position (criss-cross), the traveling block will be raised as fluid is delivered to the head end of cylinder 55 via line 157.

By-pass valve 169 serves to maintain a constant differential pressure across valve spool 152. Differential pressure is determined by the force of the spring at 172. This differential is supplemented by the pressure downstream of the valve at either cylinder port passing through the shuttle valve 171 biasing valve 169 to a flow blocking position. This force is opposed by the pilot pressure at 174 which is the pump output pressure. Should the pressure drop across spool 152 increase, valve 169 automatically responds to bypass pressure fluid from line 151 to reservoir 160 to maintain the preselected differential pressure. With a constant differential pressure maintained across valve spool 152, flow rates across the valve become a function of the area of the flow passage determined by the displacement of spool 152. The fixed pressure drop gives the operator precise metering or throttle control at valve 170 as by operation of control lever 158 the rate of flow to cylinder 55 can be regulated.

Load check valve 153 is interposed in line 154 which connects with mast legs 14 and 15 between valve 170 and cylinder 55. Load check 153 serves a lockout function as it is normally spring biased to the right placing one-way check valve in line 154. Therefore, in case of failure of the hydraulic system, fluid would not be permitted to escape from cylinder 55 across valve 153. Pressure pilot signal through 164 opposes the spring bias and places load check 153 in a straight through flow condition upon sufficient pressure occurring in line 164 to cause the valve to shift leftwardly.

Line 157 is in communication with the head end of cylinder 55 through mast legs 16 and 17 and is connected across load check valve 156 which is similar to load check 153 which serves a similar function of preventing reverse flow from the cylinder in case of hydraulic failure. The internal flow passages in mast legs 16 and 17 are connected to reservoir across auxiliary unloading valve 161. Valve 161 is shifted to open position by a pilot signal from line 154 through line 168 when valve spool 152 is in its left hand (straight through) position to permit unrestricted return flow to the reservoir. The auxiliary valve 161 becomes necessary because the opposite chambers of cylinder 55 have a two-to-one volume ratio due to the rod displacement. The unloading valve then can dump the excess volume from the head end directly to the reservoir when the rod end of cylinder 55 is pressurized.

It is desirable to have capability to operate the drive cylinder at several speed ranges in order to more efficiently perform workover operations. This is achieved in the present hydraulic system by including suitable valving in the circuit to interconnect the rod and head end of cylinder 55 under certain conditions so that hydraulic fluid, which normally would be discharged to the reservoir from the rod end, will join with the pump pressure fluid, causing the cylinder to advance at an increased rate of speed. This type of hydraulic circuit is known as a regenerative circuit. Valve 162 is the speed selection valve and when operated to the right, places the valve in a position which causes, in the lifting mode, regenerative high speed operation. Valve 152 controls the operation of valve 165 which is open in the high speed lift mode operation to shunt fluid to the head end of cylinder 55.

The operation of the hydraulic system will be better understood from the following description of operation: To initiate a snubbing or lowering operation, the operator would actuate valve spool 152 of valve 173 to the right by moving handle 158. As mentioned, valve 173 would be located at the operator's platform at panel 108 for convenient access. Pressure fluid from pump 150 will flow across valve spool 152 and through line 154 across load check valve 153 to the rod end of cylinder 55 to retract the cylinder housing 56 and move the block 24 down as indicated by the arrow. The pilot signal at line 163 will actuate valve 156 to the right, overcoming the bias of its spring. Discharge from the head end of cylinder 55 will return across valve 156, through line 157, across valve spool 152 to reservoir 160.

To initiate a low speed lifting operation, the operator will operate handle 158, shifting valve spool 152 to the left, thereby placing pump output line 151 in communication with line 157 across the valve spool. Speed selection valve 162 is maintained to the left (criss-cross) position. Pressure fluid is directed across load check valve 156 through line 157 to the head end of cylinder 55 to extend the cylinder raising the block 24. A pilot signal to valve 153 through line 164 will cause valve 153 to be moved to the left, permitting return flow from the rod end of cylinder 55 to flow back to reservoir via line 154. With the speed selector valve 162 in the right hand position, valve 165 is maintained in a closed position by virtue of the biasing spring with the hydraulic biasing pistons at the opposite ends of the valve vented to atmospheric pressure.

To initiate the regenerative or high speed lifting operation, valve 162 is shifted to the right to place its extreme left hand (straight through) passages in position. In this position, pilot signal 164 is vented and the spring bias acting rightwardly on valve 153 will position the check valve in valve 153 in line 154. Discharge flow from the rod end of cylinder 55 is now blocked at valve 153. High pressure pilot signal at 166 will shift valve 165 to the flow through position in line 175. Return flow from the contracting cylinder chamber in the rod end of cylinder 55 will then flow across valve 165 and back through line 155 to the head end of cylinder 55, supplementing the flow of fluid. Its increased flow rate will have a regenerative effect and will increase the linear velocity of the cylinder and therefore increase the speed of operation of the hoist.

The traveling block may be stopped in any position along the mast by simply returning valve spool 152 to its neutral position. In the neutral position, the check valves in load check valves 153 and 156 will be placed in position in the respective lines and prevent return flow from either end of the cylinder, thus safely locking the cylinder and the traveling block in a secure position.

It will be understood that the valves are preferably located remotely at the operator's panel 108. The mast legs comprise a portion of the hydraulic communication system as described above, connecting the valves to the cylinder 56.

The present invention also provides a novel constant tension winch for use with a workover rig that expedites pipe handling, and with the rig of the present invention, permits the block 24 to be almost continually reciprocated, thereby increasing the efficiency of the operation. Looking at FIG. 11, the numeral 180 represents a constant tension winch for use with the mast for transporting pipe between the mast to a pipe storage area or rack.

The winch assembly includes base plate 187, on which are mounted stands 178 and 179. The stands support the winch assemblies which include hydraulic motors 181 and 182, each drivingly connected to cable drums 185 and 186, respectively. Cable 183 is wound about drum 185 and cable 184 is on drum 186. The platform 187, on which the winch assembly is mounted, can be positioned at any convenient spot on the well platform to accommodate conveyance of the pipe sections. To use the winch 180, additional pulley sheaves 188 and 189 must be rotatively mounted at the upper end of the mast to carry hoist cables 183 and 184. For example, looking at FIG. 13, bracket 39 can be modified so that sheaves 188 and 189 can be rotatively carried at the top of the mast above pulley sheaves 41 and 42. Elevators 190, as shown in FIG. 10, are secured to the end of winch cables 183 and 184 and are manually engagable with the box end of pipe sections. The significant advantage provided by the constant tension winch is that it serves to exactly counterbalance the weight of the pipe being transported, keeping the cables taut, permitting the work crew to manually swing the pipe sections into the desired position with ease. The structure and operation will be described in fuller detail to comprehend a more complete understanding of this unique aspect of the invention.

The hydraulic system which controls the winch to vary the winch tension in accordance with the requirements of load supported at the elevators is shown in FIG. 9. Pump 194 is connected by hydraulic line 191 to one side of hydraulic motor 181. Return line 192 from motor 181 connects with a hydraulic reservoir. Flow control valve 193 comprises a one way check valve 193 bypassing variable restriction 206. Motive fluid is permitted to flow freely from the discharge of pump 194 to motor 181 across check valve 205, reverse flow being blocked at check valve 193 and restricted at variable restriction 206. Pilot operated pressure relief valve 195 is connected in parallel with motor 181 across lines 191 and 192 discharging to line 192 and the reservoir. A manually operable pilot valve 207 located at panel 108 is connected to direct a pilot signal via line 208 to the remote control port of pressure relief valve 195. The output torque of motor 181 and the tension developed by the winch is dependent on the pressure setting of relief valve 195. For example, a zero psi setting at valve 195 will result in no torque developed at the motor. By adjustment of valve 207, the operator can vary the torque and tension at winch 185 to raise, lower, or simply counterbalance the weight load on the winch. The desired rate of descent of the elevator load is obtained by opening relief valve 195 with the flow of hydraulic fluid being reversed across motor 181 and across adjustable orifice 206 and relief valve 195 back to line 192. The greater the restriction at 206 in valve 193, the slower the rate of elevator descent.

Elevators 190 comprise a semicircular body 197, having an axial opening 198 therethrough. The upper end of bore 198 is enlarged at 199 to conform to the collar or box end of the pipe being handled. Thus, a piece of pipe can be longitudinally inserted into the opening 198 of the elevator 190 and slipped along the pipe until the collar end of the pipe is engaged at 199. The width opening at 203 will not permit the pipe to become laterally disengaged from the elevator. A cover member 200 consists of a U-shaped handle 201 pivotally mounted at either side of the elevator body 197. A retainer bar 202 extends between the U-shaped handle so that when the handle is in the vertical position, as it would be when pipe is being raised, bar 202 will pivot and cover the upper surface of body 197, thereby restraining axial movement of the pipe from the elevator 190. Each of the drums of the winch are separately operable to expedite and facilitate handling. The controls are remotely operable from the operator's platform. The operator, by controlling the relief valve setting, can control the tension output of the drums, as has been explained. Therefore, with the present variable tension winch, an operator can raise or lower or simply counterbalance a joint of pipe, as desired. The use of two variable tension winches significantly increases the efficiency of the workover operation as it permits much more expedient handling of pipe as one pipe can be raised into place as another is being lowered. This tandem pipe handling considerably reduces the time required to work over a well.

The operation of the variable tension winch as well as the operation of the mast will become apparent from the following description of operation. FIGS. 15 through 18 show the operation cycle using the mast and winch of the present invention. When it is desired to work over a well, as for example an offshore well, the mast 11 and skid 12 would be located onto a suitable barge along with accessory equipment such as tools, pipe racks, power pack, pumps and other equipment. Each of these components and each piece of accessory equipment ordinarily will weigh less than the capacity of the average utility crane associated with most offshore platforms so that the mast equipment can safely be positioned on the platform. Because of the design of the present mast, a stroke approximately the length of the mast can be achieved. Therefore, the length of the mast can be limited to the approximate length of ordinary pipe sections, about 40 feet, and presents no particular problem in loading and unloading and transportation. Conventional barges can accommodate the mast and equipment.

When the barge arrives at the offshore well, the utility crane raises the mast skid 12 into the proper location on the offshore platform adjacent the well head. The mast structure is then swung into position by the crane on the platform in a horizontal position. Pivot pin 96 would be connected to the mast. The mast is now horizontally positioned on the platform supported by the cylinder 91, and a support port, not shown. The hoisting cylinder 91 would be pressurized and the mast would be pivoted into a vertical position resting on pads 20. The work platform is mounted on the mast and the hydraulic system connected to the power pack 134. The power pack may be located on skid 12 with the mast or may be remotely located at any convenient location.

The well head stack 110 may now be located on the well head. The stack is placed with flange 119 resting on the well head flange and flange 119 is turned until the holes 104 align with the holes in brackets 115. The well stack 110 is then secured at bolts 116 and threaded member 120 is extended until the entire weight of the mast is supported on the well head. The well head flange is secured to flange 119 and any force exerted by the mast in pushing or pulling pipe is transmitted to the well head at the casing rather than being imposed on the deck of the platform. This is a particular advantage because many platforms are not designed to handle the high unit loading on the deck that would be imposed in operation by a workover rig of this type.

With the mast assembled, provision may be made for operation with the constant tension winches. To accommodate the winches, as seen in FIG. 13, bracket 39 is extended vertically to rotatively support sheaves 188 and 189 which are located at top of mast above the crown pulleys. Winch assembly 180 is placed adjacent the rear side of the mast with cables 183 and 184 disposed over sheaves 188 and 189 so that elevator 190, attached to the end of cables, will assume a slack position at the front legs of the mast in line with the operator's platform. The hydraulic motors 181 and 182 are connected to a source of hydraulic fluid by quick connect couplings or the like.

The mast is now ready to be placed in operation. Generally, at least a three man crew, two men located on the operator's platform and one man located adjacent the mast at the pipe rack, would be required to perform a workover operation. The man at the pipe rack would be responsible for engaging elevator 190 on the end of the pipe or disengaging elevator 190, as the case may be. One man on the operator's platform is responsible for remotely controlling the operation of the pipe engaging fixtures 37 and 38 in traveling block 24 and the pipe engaging bowls 121 and 122 at the well head and for operating the hydraulic system that actuates the main cylinder to raise and lower the traveling block, the other man would control the two variable tension winches that raise and lower the pipe joints to working level. The two men on the platform would also cooperate to manually engage or break the pipe joints as they come into position at the operator's platform, using wrenches or power tongs.

Figure 15:
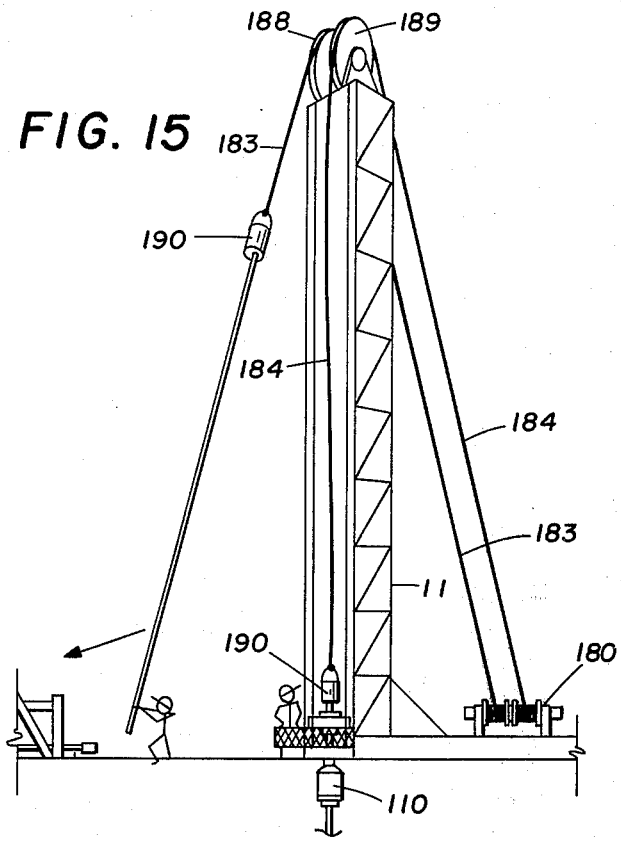
Figure 16:
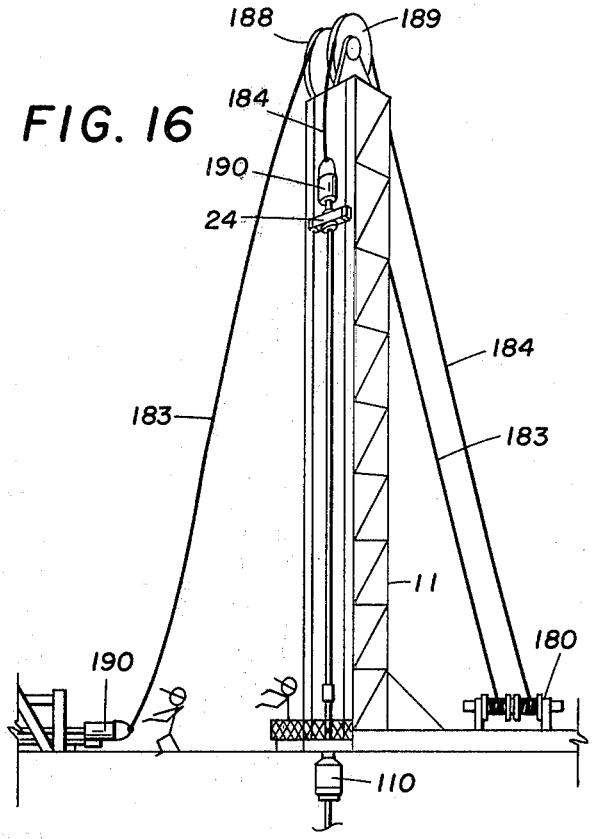
Figure 17:
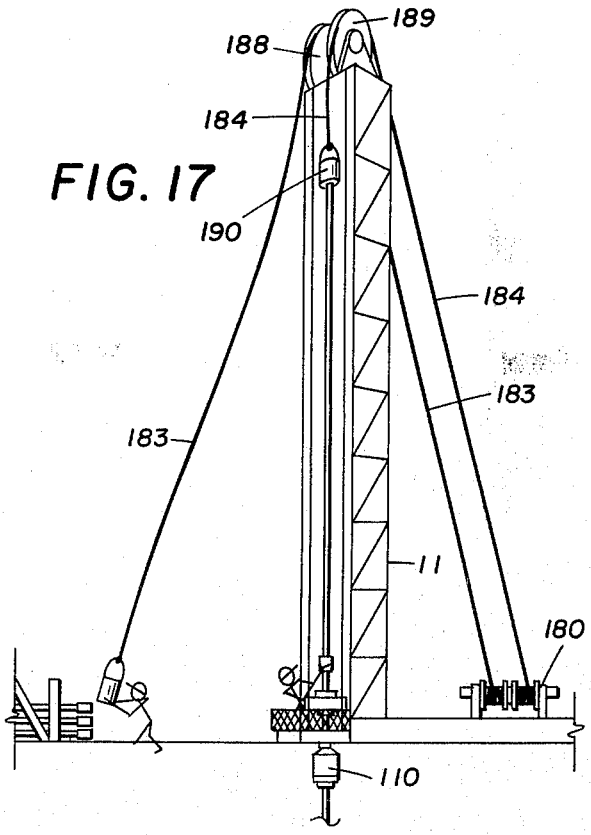
Figure 18:
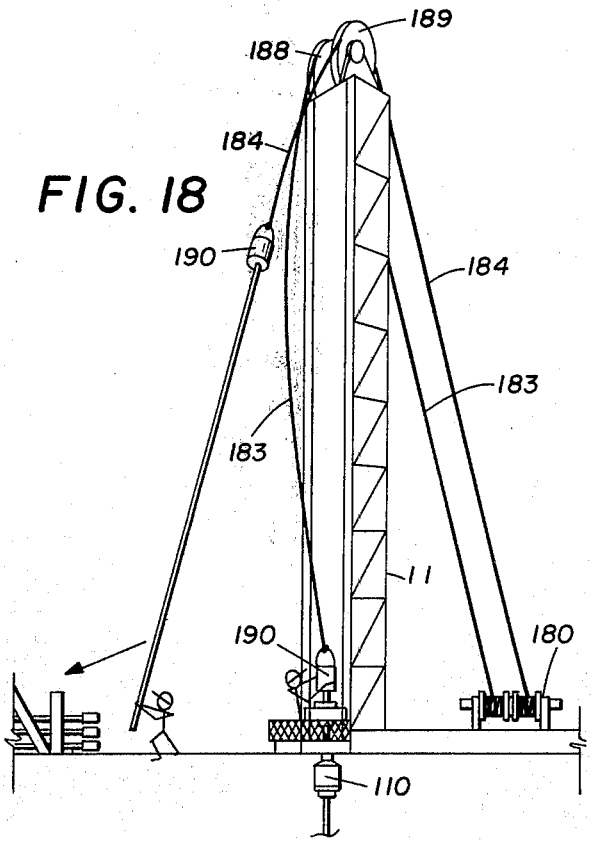

The procedure for removing the pipe string from the well casing is shown in FIGS. 15 to 18. As seen in FIG. 15, to commence removal of the string of pipe from the hole, a crew member will place shuttle elevator 190 on cable 184 over the extending end of pipe with the traveling block engaged below the elevator. The previously removed pipe section on elevator 190 at cable 183 is shuttled to the pipe storage area. The lower pipe slips in the well stack 110 are disengaged and the slips 37 in block 24 are engaged and the lift cylinder 55 is actuated so that the traveling block 24 is caused to ascend, pulling the pipe length from the casing to the position as seen in FIG. 16. Traveling block 24 is then released by disengaging the slips and lowered along the pipe string to a location below the collar on the next lower adjacent piece of pipe. The winch tension is controlled by valve 207 to automatically take-up cable 184 as the pipe is raised by block 24. The lower slips in the well stack 110 are engaged and the removed length of pipe is twisted, breaking the connection as seen in FIG. 17. The winch operator may then lower the removed piece of pipe to the pipe rack by operating the appropriate hydraulic winch to pay out cable 184. The second elevator 190 on cable 183 is shuttled manually to the crew at the well for placing at the upper column end of the pipe extending from the casing, completing the operation as seen in FIG. 18. The pipe removal procedure can be repeated until the desired length of pipe has been removed.

Conversely, to perform a lowering operation, that is, snubbing pipe into the well, initially the upper end of length of pipe would be in a position extending from the well casing, terminating at approximately the elevation of the operator's platform. The pipe engaging grips at the well head stack 110 are hydraulically actuated to engage the pipe to prevent movement of the pipe in the casing. If the well is under pressure, the snubber bowl 121 would be set to engage the upper end of the pipe string to prevent it from being expelled from the casing. If the well is dead, the slip bowl 120 is actuated to prevent the pipe from descending into the casing prior to securing an additional length of pipe at the upper end.

Simultaneously with the above operation, the crew member located at the pipe storage area would place an elevator 190 on the end of a pipe joint. One of the crew men on the platform would operate the motor on the hydraulic variable tension winches 180 to raise the loaded section of pipe in a vertical position over the well head and then adjust the relief valve 193 until the torque developed by the winch counterbalances the weight of the pipe. One of the crew on the platform would stab the lower, threaded end of the raised pipe into the upper end of the pipe extending from the casing. The upper section would be turned a few quick turns with a wrench or power tool engaging the pipe sections. The main lift cylinder would be pressurized by shifting valve 173 to its rightward position to cause traveling block 24 to ascend on its rollers along the front mast legs. At some predetermined height, traveling block 24 would be stopped by shifting valve 173 to neutral and the slips of snubber bowl of block 24 engaged. Lift cylinder 55 is actuated to cause the traveling block to force or snub the pipe into the hole. Prior to this, of course, the lower slips in bowl 110 have been disengaged. The length of the stroke is dependent upon the well conditions and will usually vary from six to fifteen feet. The column strength of the pipe, the pressure existing in the well, and the length of string of pipe in the well, all bear on the length of the stroke permissible. The block 24 and the slips are continued to be operated in a stroking procedure until the pipe string has been forced into the casing until elevator 190 is about at the level of the operator's platform. The stroking is ceased and the remotely controlled slips in the well head stack 110 are again engaged and the traveling block slips are disengaged. Elevator 190 is manually removed from the end of the pipe string and manually transferred to the crew member at the pipe rack so that he may attach the elevator to another piece of pipe for lifting into position. While the stroking operation was taking place, the second winch motor was operated to lift another length of pipe into vertical position, ready for attachment in the manner just described to the string of pipe. Thus, the use of the dual variable tension winch to continually shuttle pipe section from the pipe rack to the well considerably reduces "dead time" and permits almost continued use of traveling block 24.

The variable tension winch, when in a counterbalancing situation, will serve to take up any slack in its cable. The use of two winches in the manner described is highly expedient in that one elevator is always in the position of use while the other elevator is transporting pipe between the mast and pipe rack. Also, the most efficient use is being made of the traveling block as the traveling block is being continually, or almost continually, operated with almost no down time.

When the traveling block is lifting, the load or weight imposed on the traveling block is transmitted to the front legs of the mast and to the well casing, rather than to the supporting platform structure. Further, since the front mast legs are pressurized as described before, the mast structure itself sees almost no load. This contributes to the economy and lightness of design.

Thus, the present invention provides a highly efficient mast structure and workover method. The mast of the present invention achieves a substantial stroke with a cylinder half the length of the stroke. Of course, it would be obvious to incorporate additional pulleys and further reduce the stroke of the cylinder required. However, from most operations it has been found that the two to one ratio described herein is most efficient. Further, the mast of the present invention is pressure compensated to eliminate hook loads and shock loadings imposed on the mast. The mast is extremely light weight and compact and in operation is, in effect, isolated from the platform on which it is working, so that all loadings are transmitted to the well casing rather than to the platform. A further advantage of the invention described herein is the capability of multiple speed operation which is highly desirable in many oil field operations. The mast of the present invention has the capability of snubbing and pulling pipe and may be also used in such operations as drilling a new well.

It will be apparent to those of ordinary skill in the art upon reading the present disclosure to make various changes in the method and the herein disclosed invention. It is the intent, however, that the concepts disclosed herein be limited only by the appended claims.

What is claimed is:

1. A mast structure comprising:

at least one load supporting structural member, load carrying means associated with said load supporting structural member, hydraulic actuator means operatively connected to said load carrying means, said actuator divided by a movable barrier into a first chamber which when pressurized is adapted to operate said load carrying means in a first direction and a second chamber which when pressurized is adapted to drive said load carrying means in a second direction, hydraulic compensation means for compensating the loading induced on said load supporting member by the load at said load carrying means, said compensator means including:

said load supporting member defining a hydraulic supply passageway extending longitudinally in said load supporting member, having a predetermined effective area proportional to the effective area of said movable barrier, means connecting said supply passageway to said first chambers, and means connecting said supply passageway to a source of fluid pressure whereby the first chamber hydraulically communicates with said source of fluid pressure through said supply passageway and whereby the pressure force exerted in said loading supporting structural member responds to compensate the load supporting member by exerting a force oppositely and approximately equal to the load experienced at said load carrying member.

2. The mast structure of claim 1 wherein said actuator is a linear actuator.

3. The mast structure of claim 2 wherein said load carrying means includes a traveling block adapted to connect to a load and reciprocable along said load supporting member and a power transmission system operatively connected to said traveling block and operatively engaged by said actuator to move said load.

4. The mast structure of claim 3 wherein said power transmission system is a pulley system having a 2:1 differential cable ratio and wherein the area of said supply passageway has an area approximately one-half that of said movable barrier.

5. A workover rig comprising:

a mast structure including a front load supporting member and a rear load supporting member, hoist means on said mast, said hoist means including lifting means adapted to connect to a load and pulley means operatively connected to raise and lower said lifting means, said hoist arranged on said mast to impose a compressive load on said front member when said hoist is raised, linear actuator means on said mast structure having a piston dividing the actuator into first and second pressure chambers, said actuator operatively connected to said pulley means to raise said hoist means when said first chamber is pressurized, hydraulic compensation means for compensating the loading induced on said front member when the hoist is raised, said means including:

said front member defining a longitudinal hydraulic passageway having a cross-sectional area proportional to the effective cross-sectional area of said first cylinder chamber, enclosure means closing the upper end of said hydraulic passageway, means connecting said supply passageway to said first cylinder chamber, and means connecting said supply passageway to a source of fluid pressure whereby the pressure force exerted in said front member against said closure responds to oppose and compensate the compressive load fluctuations experienced in said front member.

6. The rig of claim 5 wherein said first member comprises legs, each defining a supply passageway connected to said cylinder chamber, the total cross-sectional area of the two passageways approximating one-half the cross-sectional area of said first chamber and wherein said hoist means have an approximate 2:1 ratio.

7. The rig of claim 6 wherein said rear member is hollow and defines a second hydraulic passageway, said second passageway being connected to said second cylinder chamber and having a cross-sectional area approximately equal to one-half the effective area of said second chamber and further including valve means for selectively directing fluid through either of said legs to said cylinder.

8. The rig of claim 7 wherein said hoist system is arranged and adapted to impose substantially all hoist loads as compressive loads on said front legs when the hoist is raised and substantially all hoist loads as compressive loads on said rear leg when the hoist is lowered.

9. The rig of claim 8 wherein said first cylinder chamber is in the head end of the cylinder and said second cylinder chamber is in the rod end of the cylinder.

10. The method of pressure compensating a mast structure having a frame supported hoist system operated by a hydraulic cylinder having first and second pressure chambers comprising:

arranging the hoist to impose substantially all hoist loads as compressive loads on predetermined frame members when said hoist is operated in a first direction by pressurizing a first cylinder chamber, pressurizing passageways in said predetermined frame members with fluid pressure at substantially the pressure existing in said first cylinder chamber, said passageways having predetermined cross-sectional areas whereby substantially all compressive hoist loads are opposed and compensated by said internal fluid pressure forces.

11. A workover rig adapted for use with an oil well having an outer well pipe enclosing casing terminating at a flanged well head, said structure comprising:

a vertically extending mast structure having a base member adapted to support a load thereon, hoist means adapted to vertically traverse said mast and having lift means thereon adapted to engage the well pipe, power means operatively connected to said hoist means to selectively raise and lower same, well head stack means adapted to secure said mast structure to said well head, said stack means including frame means secured to said mast, stack flange means adapted to be secured to said well head flange, adjustable coupling means connecting said frame and stack flange and adjustable to cause the weight of said mast structure to be substantially transferred from said base to said well casing.

12. The rig of claim 11 wherein said well head stack means further includes slip bowl means adapted to selectively engage the well pipe.

13. The rig of claim 12 wherein said well head stack means further includes snubber bowl means adapted to selectively engage the well pipe.

14. The rig of claim 11 wherein said stack frame means are adjustably secured to said mast structure.

15. The rig of claim 11 wherein said base is a movable platform member and said mast is pivotally affixed to said platform and may be pivoted from a horizontal position of non-use to a vertical position of use.

16. The rig of claim 11 wherein said adjustable coupling comprises a threaded collar member on which said stack flange is mounted.

17. A workover rig adapted for use with an oil well having an outer casing enclosing well pipe and terminating at an upper flanged well head, said rig comprising:

a mast structure having a base member and at least a pair of vertically extending load supporting members, hoist means including traveling block means vertically reciprocable between said legs and having lift means thereon adapted to engage the well pipe, pulley means supported on said mast and operatively connected to said traveling block including power means operatively connected to raise and lower said hoist means, well head stack means adapted to secure said rig to said well head flange, said stack means including a support member secured to said load supporting legs, a housing member including an extendable threaded collar carrying flange member adapted to be secured to the well head flange whereby extension of said threaded collar causes the weight of said mast to be transferred to and supported substantially by said casing.

18. The rig of claim 17 wherein said well head stack has a central opening therein adapted to receive the well pipe and further including selectively actuable pipe gripping means in said housing disposed about said opening.

19. The rig of claim 18 wherein said pipe gripping means includes pipe slip and snubber bowls.

20. The rig of claim 17 wherein said hoist is a cable pulley arranged and said power means includes a hydraulic actuator to power said cable pulley.

21. A workover rig comprising:

a mast structure having at least a pair of vertical leg members, a cross head supported on said leg members at a predetermined elevation, first and second crown pulleys supported on the upper part of said mast structure, first and second base pulleys supported on the lower part of said mast structure, a traveling block adapted to lower or raise a load, said block being vertically reciprocable along said leg members, a hydraulic actuator having a piston rod rigidly secured at the cross head and arranged such that the cylinder housing will be moved downwardly along the mast when pressurized to place the piston rod in compression, a first pair of traveling pulleys rotatable about a first trunnion mounted on the cylinder housing adjacent the bearing end of the cylinder, a second pair of traveling pulleys rotatable about a second trunnion oppositely aligned with said first trunnion, a first cable system cooperating with said first base, crown, and pair of traveling pulleys in a double purchase arrangement and being secured to said traveling block, a second cable system parallel to said first system cooperating with said second base, crown, and pair of traveling pulleys in a double purchase arrangement and being secured to said traveling block, whereby said actuator may be selectively pressurized to operate said hoist means and whereby part of the lift load imposed on the mast is opposed by the reaction load from said actuator at said cross head.

22. The rig of claim 21 wherein said traveling block is provided with roller means which cooperably engage and guide said traveling block on said legs.

23. The rig of claim 21 wherein said vertical leg members are secured to a horizontal base member.

24. The apparatus as defined in claim 22 wherein said traveling block further includes rotary table means adapted to connect to a well pipe.

25. The apparatus as defined in claim 24 wherein said traveling block further includes pipe engaging means which may be selectively operated to engage a well pipe.

26. The apparatus as defined in claim 25 wherein said rotary table and pipe engaging means are remotely actuable.

27. A workover rig for a well having a casing comprising:

a mast structure having vertical frame members, a cross head member supported on said mast structure, a crown pulley mounted on the upper part of said mast and a base pulley mounted on the lower part of said mast, a hydraulic actuator having a piston rod within a barrel dividing the barrel internally into a head and bearing end chamber, said actuator having said rod affixed to the cross head whereby upon pressurization said barrel may be selectively reciprocated along said mast, a pair of traveling pulleys affixed to the barrel of said cylinder, a cable system interconnecting said pulleys in a double purchase arrangement whereby reciprocation of said barrel will advance said lift means a greater proportional distance along the mast frame, means associated with said mast for supporting said mast on the casing in a position of use, and said frame members defining hydraulic passageways connected to said head and end chambers to actuate said cylinder, said passageways having a cross-sectional area approximating the effective area of the respective chambers, whereby fluid pressure in said frame members compensates for the compression loads imposed on said frame members.

28. A workover rig for a well having pipe within a casing comprising:

a mast structure having two vertical front leg members and two vertical rear leg members structurally interconnected and secured to a base platform, a cross head member supported on said mast structure at a predetermined elevation defining first and second passages therein, a hydraulic actuator having a piston rod within a barrel dividing the barrel internally into a first chamber and second chamber, said actuator having said rod affixed to the cross head, said rod defining first and second passageways communicating with the first and second chambers, said first chamber communicating through said rod with said cross head first passage and said second chamber communicating through said rod with said second passage, said front leg members each defining first fluid ducts communicating with said first passages in said cross head, the total cross-sectional area of said first ducts being approximately equal to the effective cross-sectional area of the first chamber, said rear leg members each defining second fluid ducts communicating with said second passageways in said cross head, the total cross sectional area of said second ducts being approximately equal to the effecttive cross-sectional area of the second chamber, hydraulic power means including a source of pressure fluid and valve means adapted to selectively direct fluid to either said first or rear legs to extend or retract said cylinder barrel along said mast, first and second crown pulleys mounted on the upper part of said mast, first and second base pulleys mounted on the lower part of said mast, equalizing means secured to said mast, a first pair of traveling pulleys mounted on the cylinder barrel, a second pair of traveling pulleys mounted on the cylinder barrel opposite said first pair, a cable having its ends secured to the mast and continuously arranged around said first pulleys in a double purchase arrangement having a vertical traveling section extending between said first crown and first base pulleys adjacent one of said front legs and interconnected across said equalizing means with said second pulleys in a parallel double purchase arrangement including a vertical traveling section extending between said second crown and second base pulleys adjacent said other front leg, whereby reciprocation of said cylinder barrel vertically displaces said traveling pulleys, traveling block means connected to said vertical traveling cables, said traveling means having means therewith adapted to engage a pipe, well head stack means secured to said mast structure and having flange means adapted to secure to the well head, said stack being vertically adjustable to transfer the weight of the rig to said well casing, and speed control means associated with said hydraulic cylinder, said speed control means comprising regenerative circuit means for selectively diverting discharge from said second chamber to said first chamber, whereby said pulley system may be selectively operated to advance pipe within said casing and wherein said pressure fluid in said legs applies a load on the mast opposite to the load imposed on said legs from the weight of the pipe and compensates same.

29. The rig of claim 28 wherein said traveling block and said well head stack includes hydraulic remotely operable pipe engaging means.

30. The rig of claim 29 wherein said traveling block further includes rotary table means.

31. The rig of claim 30 including an operator's platform supported on said front legs.

32. The rig of claim 31 wherein the controls for said hydraulic actuated means are located at the operator's platform.

33. A hoist apparatus comprising:

a mast structure;

traveling sheave means movable along the mast structure;

crown sheave means mounted on the upper end of the mast structure;

cable means secured at one end to the upper end of the mast structure and passing first around the traveling sheave means and then around the crown sheave means;

lift means secured to the other end of the cable means; and a linear actuator interconnecting the upper end of the mast structure and the traveling sheave means for applying a force between the upper end of the mast structure and the traveling sheave means for forcing the traveling sheave means downwardly to thereby raise the lift means.

34. The hoist apparatus of claim 33 further characterized by:

second traveling sheave means movable along the mast structure;

base sheave means mounted at the lower end of the mast structure;

second cable means secured at one end to the lower end of the mast structure and passing first around the second traveling sheave means and then around the base sheave means, and then being attached to the lift means;

said linear actuator being connected to apply a force between the upper end of the mast structure and the second traveling sheave means for forcing the second traveling sheave means upwardly to thereby lower the lift means.

35. The hoist apparatus of claim 33 wherein the linear actuator is a hydraulic actuator having a cylinder and a rod, the rod being connected to the upper end of the mast structure and the cylinder being connected to the traveling sheave means.

36. The hoist apparatus of claim 33 wherein the traveling sheave means comprises an equal number of sheaves disposed on each side of the linear actuator;

the crown sheave means comprises a corresponding number of sheaves disposed on each side of the point at which the linear actuator is attached to the mast; and the cable means includes two parallel cable systems for equalizing the load on the linear actuator.

37. The hoist apparatus of claim 33 wherein the lift means comprises remotely operable slip means for gripping and exerting an upwardly directed force on a tubular member extending through the lift means.

38. The hoist apparatus of claim 37 wherein the lift means includes powered means for rotating the slip means and the tubular member gripped thereby.

39. The hoist apparatus of claim 34 wherein the lift means comprises remotely operable slip means for gripping and exerting downwardly directed force on a tubular member extending through the lift means.

40. The hoist apparatus of claim 39 wherein the lift means includes powered means for rotating the slip means and the tubular member gripped thereby.

41. A workover rig for use with an oil well having a casing adapted to receive an inner pipe string comprising:

a rigid mast structure for disposition vertically above the casing;

pipe engaging means traveling along the mast structure for engaging and exerting a force on the inner pipe string longitudinally of the pipe string;

drive means for driving the pipe engaging means along the mast while transferring the load on the pipe engaging means to the mast;

means for supporting the mast in an erect position on a support surface adjacent the top of the casing before the mast is connected to the outer casing; and connection means between the mast and casing for transmitting loads imposed on the mast by the pipe engaging means to the casing.

42. The workover rig of claim 41 wherein the pipe engaging means can be driven upwardly to impose a downwardly directed load on the mast which is transmitted through the connection means to the casing.

43. The workover rig of claim 41 wherein the pipe engaging means can be driven downwardly to impose an upwardly directed load on the mast which is transmitted through the connection means to the casing.

44. The workover rig of claim 41 wherein the connection means has an adjustable length to accomodate different heights between the supporting surface and the casing.

45. The workover rig of claim 41 wherein the connection means comprises a stack including:

a lower flange for connection to the casing flange on the upper end of the casing;

a slip bowl for slip means for engaging and supporting the pipe string;

a snubbing bowl for snubbing slip means for engaging and holding the pipe string in the casing against well pressure;

adjustable means for varying the length of the stack after the stack has been placed in position on the casing flange to transfer at least a portion of the static weight of the mast from the means for supporting the mast structure to the casing flange.

46. The workover rig of claim 45 further characterized by means for connecting the upper end of the stack to the mast structure at different heights before any weight of the mast is transferred to the casing flange by the adjustable means whereby relatively large variations in the vertical distance between the supporting surface and the vertical flange can be accommodated.

47. A workover rig for use with an oil well having a casing adapted to withstand substantial vertical loads and to receive a pipe string comprising:

a rigid mast structure for disposition vertically above the casing;

pipe engaging means traveling along the mast structure for engaging and exerting a longitudinal force on the pipe string;

drive means for driving the pipe engaging means along the mast while transferring the load on the pipe engaging means to the mast;

first means for engaging a support surface near the casing and for supporting the mast in an erect position above the casing; and second means for connecting the mast to the casing and transmitting loads imposed on the mast by the pipe engaging means to the casing;

at least one of the first and second means being vertically adjustable to accomodate different vertical distances between the support surface and the casing.

48. A system for applying a variable force to an object comprising:

a support structure;

means associated with the support structure for applying the force to the object with a variable resulting force applied to the support structure;

the support structure having at least one hollow structural member which is subjected to a compressive load by the variable resulting force, the hollow structural member being capable of confining hydraulic fluid; and means for applying hydraulic fluid to the hollow structural member having a pressure proportional to the variable resulting force whereby the hydraulic fluid will produce a tension force in the hollow structural member tending to at least partially reduce the compressive load on the hollow structural member.

49. The system of claim 48 wherein the means associated with the support structure is a hydraulic actuator which produces a hydraulic back pressure proportional to the force; and the hydraulic pressure applied to the tubular structural member is the hydraulic back pressure.

50. The system of claim 49 wherein the hydraulic actuator is a hydraulic linear actuator having a rod and piston disposed in a cylinder.

51. The system of claim 48 wherein the means associated with the support structure comprises means for driving a load along the support structure.

52. The system of claim 48 wherein the support structure and the means associated therewith comprises a system for hoisting a load.

53. The system of claim 52 wherein the support structure is an upright mast structure and the means associated therewith moves a load along the mast structure.

54. The system of claim 53 wherein the load is moved along the mast structure by cable means extending over the sheave means connected to the upper end of the mast structure.

55. The system of claim 54 wherein the means associated with the support structure includes means for engaging and lifting a string of pipe.

56. The system of claim 55 wherein the means associated with the support structure includes cable means extending around base sheave means connected to the lower end of the mast structure and extending upwardly to means for engaging a string of pipe and exerting a downward force on the pipe.

57. A rig for drilling and servicing oil wells comprising:

an upright mast, pipe engaging means movable vertically along the mast, said pipe engaging means including an opening through which a string of pipe including collars may pass and slip means for engaging the pipe string at any midpoint to support and rotate the pipe, and drive means for rotating the slip means and the pipe engaged thereby, and means for moving the pipe engaging means along the mast to raise and lower the pipe engaging means.

58. A rig for snubbing pipe into a well against the pressure of the well comprising:

a fixed upright mast including means for connecting the mast to the well head;

pipe engaging means movable along the mast having slip means for engaging any midpoint of a joint of pipe and exerting a downward force on the pipe joint, and means for driving the pipe engaging means in each direction along the mast including at least one crown sheave journaled near the top of the mast, at least one base sheave journaled near the bottom of the mast, first cable means passing around the base sheave upwardly to the pipe engaging means for moving the pipe engaging means downwardly, second cable means passing around the crown sheave and downwardly to the pipe engaging means for moving the pipe engaging means upwardly, whereby net forces acting downwardly on the pipe as a result of gravity and net forces acting upwardly on the pipe as a result of well pressure will be transmitted successively through the pipe engaging means, through the means for driving the pipe engaging means, through the mast and the means for connecting the mast to the wellhead, and finally to the wellhead.

* * * * *